US006802564B2

(12) United States Patent
Brockway et al.

(10) Patent No.: US 6,802,564 B2
(45) Date of Patent: Oct. 12, 2004

(54) EXAMINATION AND TREATMENT CHAIR

(75) Inventors: Charles Brockway, Greenville, OH (US); Donald Lietzenmayer, Pisgah Forest, NC (US)

(73) Assignee: Midmark Corporation, Versailles, OH (US)

( * ) Notice: Subject to any disclaimer, the term of this patent is extended or adjusted under 35 U.S.C. 154(b) by 30 days.

(21) Appl. No.: 09/976,006

(22) Filed: Oct. 12, 2001

(65) Prior Publication Data

US 2003/0071503 A1 Apr. 17, 2003

(51) Int. Cl.[7] ..... A47C 1/02
(52) U.S. Cl. ..... 297/330; 297/300.1; 297/316
(58) Field of Search ..... 297/316, 317, 297/318, 322, 323, 325, 361.1, 330, 411.29, 411.2, 337, 340, 300.1, 300.2, 301.1, 353

(56) References Cited

U.S. PATENT DOCUMENTS

| | | | | | |
|---|---|---|---|---|---|
| 3,414,324 | A | * | 12/1968 | Taylor et al. | |
| D221,764 | S | | 9/1971 | Johnston | D24/178 |
| D221,765 | S | | 9/1971 | Johnston | D24/178 |
| 3,698,765 | A | | 10/1972 | Olsen | 297/396 |
| 3,729,227 | A | | 4/1973 | Ohta | 297/391 |
| 3,866,973 | A | | 2/1975 | Heubeck | 297/316 |
| 3,934,928 | A | * | 1/1976 | Johnson | |
| 3,984,146 | A | * | 10/1976 | Krestel et al. | 297/330 |
| 4,173,372 | A | | 11/1979 | Norris | 297/345 |
| D255,622 | S | | 7/1980 | Ota | D6/22 |
| D260,703 | S | | 9/1981 | Pearson | D6/22 |
| D268,149 | S | | 3/1983 | Case | D6/22 |
| 4,415,203 | A | | 11/1983 | Cawley | 297/391 |
| 4,492,407 | A | * | 1/1985 | Broadhead | |
| 4,541,671 | A | * | 9/1985 | Broadhead et al. | 297/330 |
| 4,956,592 | A | | 9/1990 | Schulte et al. | 318/560 |
| 5,015,035 | A | * | 5/1991 | Stoeckl et al. | |
| 5,190,349 | A | | 3/1993 | Austin, Jr. et al. | 297/316 |
| 5,267,778 | A | | 12/1993 | Krebs et al. | 297/330 |
| D347,065 | S | | 5/1994 | Castellini | D24/178 |
| D347,946 | S | | 6/1994 | Nordstrom et al. | D6/367 |
| 5,320,415 | A | * | 6/1994 | Krebs | |
| 5,395,160 | A | * | 3/1995 | Krebs et al. | |
| D361,438 | S | | 8/1995 | Spencer et al. | D6/367 |
| D378,961 | S | | 4/1997 | Nordstrom et al. | D6/361 |
| D384,154 | S | | 9/1997 | Malmen et al. | D24/178 |
| D420,225 | S | | 2/2000 | Lamb et al. | D6/367 |
| 6,212,713 | B1 | | 4/2001 | Kuck et al. | 5/617 |
| D462,189 | S | * | 9/2002 | Brockway et al. | D6/367 |

* cited by examiner

*Primary Examiner*—Lanna Mai
*Assistant Examiner*—Stephen Vu
(74) *Attorney, Agent, or Firm*—Wood, Herron & Evans, LLP

(57) ABSTRACT

An examination and treatment chair is operable to move between a generally upright patient entry/exit position and a reclined patient examination and treatment position. The chair includes a seat section and a beck section that moves between a generally upright position and a reclined position. Arm rests are rigidly connected to the back section and move with the back section. The arm rests are automatically positioned to allow a patient unobstructed entry into or exit from the chair.

7 Claims, 3 Drawing Sheets

EXAMINATION AND TREATMENT CHAIR

FIELD OF THE INVENTION

The present invention relates generally to articulated chairs and, more particularly, to an articulated chair operable to move between a generally upright patient entry/exit position and a reclined patient examination and treatment position.

BACKGROUND OF THE INVENTION

Articulated examination and treatment chairs are used to position a patient to a variety of different positions which may be selected in accordance with the particular procedure being performed and with reference to the preferences of the particular operator or doctor. For dental procedures, by way of example, the chair may be moved between a generally upright patient entry/exit position and a reclined patient examination and treatment position.

The chair has a seat section and a back section that provide a comfortable support surface for the patient throughout movement of the chair. Arm rests are provided on opposite sides of the chair to support the patient's arms as the chair is moved through the various positions. To provide patient comfort, the arm rests must move or tilt to accommodate the change in position of the patient as the patient moves through the various positions. To accomplish this need, arm rests have either been connected for pivotal movement with the seat section or the arm rests are pivotally connected to the back section through a rotatable shaft and linkages.

In the generally upright patient entry/exit position of known examination and treatment chairs, the arm rests obstruct the patient's entry into or exit from the chair. Therefore, the arm rests are constructed either to be temporarily removed or to pivot out of the way to allow patient to enter or exit the chair. Either of these solutions has a tendency to be cumbersome, especially for handicapped and elderly patients.

Therefore, there is a need for an chair that improves patient entry or exit while providing comfort to the patient during movement of the chair between entry/exit and examination and treatment positions.

SUMMARY OF THE INVENTION

The present invention overcomes the foregoing and other shortcomings and drawbacks of examination and treatment chairs heretofore known. While the invention will be described in connection with certain embodiments, it will be understood that the invention is not limited to these embodiments. On the contrary, the invention includes all alternatives, modifications and equivalents as may be included within the spirit and scope of the present invention.

An examination and treatment chair in accordance with the principles of the present invention is operable to move between a generally upright patient entry/exit position and a reclined patient examination and treatment position. The chair includes a chair support for supporting a seat section and back section of the chair. The back section is mounted for pivotal movement relative to the chair support between a generally upright position and a reclined position. A pair of arm rests are rigidly connected to the back section for movement with the back section between the generally upright position and the reclined position.

In accordance with the principles of the present invention, the arm rests are automatically positioned to allow a patient unobstructed entry into or exit from the chair when the back section is moved to the generally upright position. The arm rests are automatically positioned to support the patient's arms when the back rest is moved to the reclined position.

In accordance with one aspect of the present invention, the back section includes a back frame and a back cushion supported on the back frame. The arm rests may be integrally formed with the back frame such as by a unitary casting of the back frame and the arm rests or, alternatively, the arm rests may be rigidly connected to the back frame. The back frame and foam cushion are dished so that the arm rests and the dished or contoured back section comfortably cradle the patient in a natural, relaxed position to maximize patient comfort and reduce patient anxiety.

The chair of the present invention provides a patient with unobstructed entry into or exit from the chair in the generally upright patient entry/exit position and a natural, relaxed and comfortable support in the reclined patient and treatment position. The foam cushion provides patient comfort in the lumbar region of the patient's back and forces the patient's shoulders back, which naturally elevates the patient's chin and puts the patient in a good working position.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
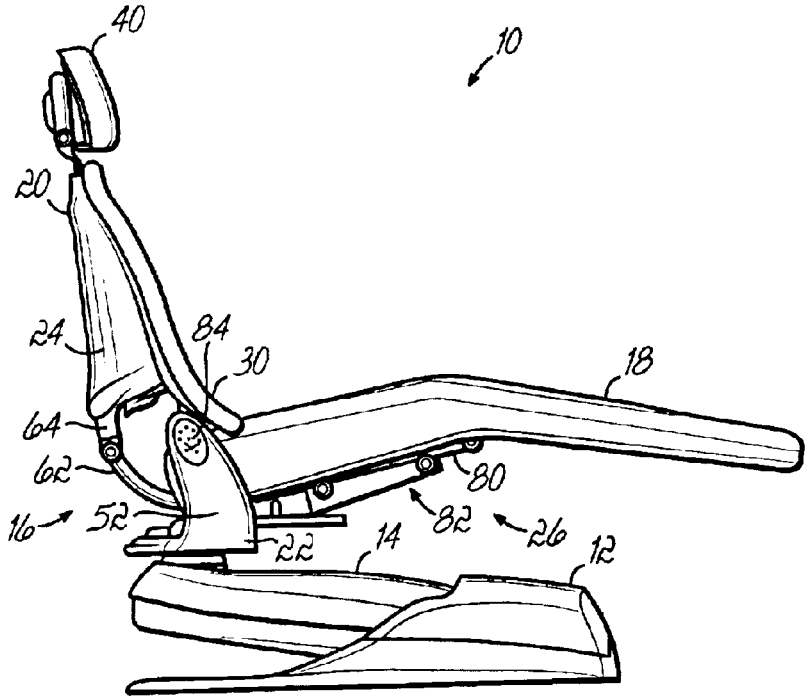
FIG. 1 is a side elevational view of an articulated examination and treatment chair in accordance with the principles of the present invention, illustrating the chair in a generally upright patient entry/exit position.
Figure 2:
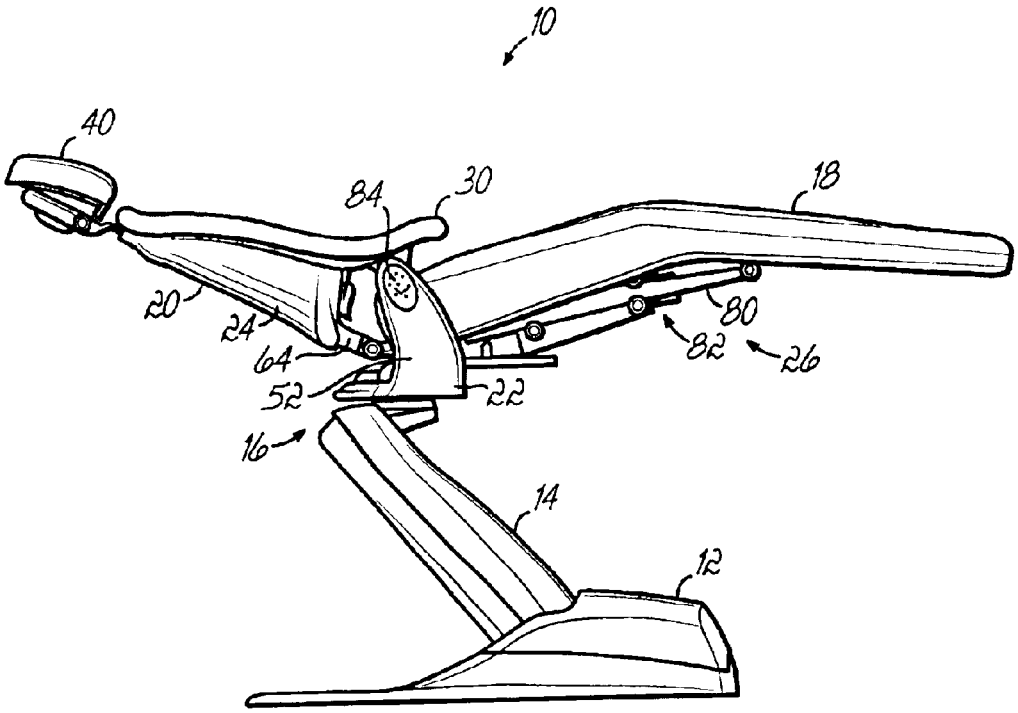
FIG. 2 is a view similar to FIG. 1, illustrating the chair in a reclined patient examination and treatment position.
Figure 3:
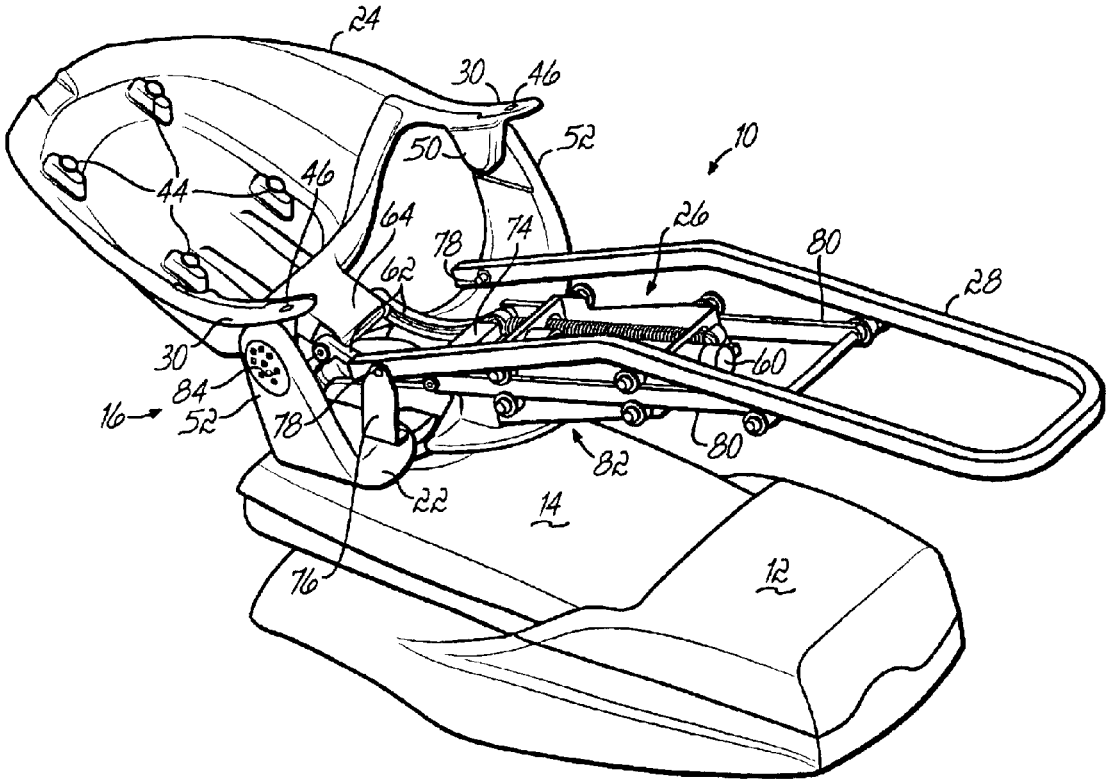
FIG. 3 is a perspective view of the chair in the reclined patient examination and treatment position with seat and back cushions removed.

With reference to the Figures, and to FIGS. 1–3 in particular, an articulated examination and treatment chair 10 is shown in accordance with the principles of the present invention for moving between a generally upright patient entry/exit position (FIG. 1) and a reclined patient and treatment position (FIG. 2). As will be described in detail below, the chair 10 provides a patient with unobstructed entry into or exit from the chair 10 in the generally upright patient entry/exit position and a natural, relaxed and comfortable support in the reclined patient examination and treatment position.

Further referring to FIGS. 1–3, the chair 10 includes a chair base secured to a support structure, such as a floor, a conventional lift arm 14 having one end connected to the chair base 12, and a chair support assembly 16 for rotatably supporting a seat section 18 and a back section 20 of the chair 10 on the opposite end of the lift arm 14. As shown in FIG. 3, the chair support assembly 16 includes a yoke member 22 supported on the lift arm 14 in a conventional manner for pivotally supporting a back frame 24 of the back section 20. A seat support 26 is mounted to the lift arm 14 for pivotally supporting a seat frame 28 of the seat section 18.

In accordance with the principles of the present invention, the back frame 24 may comprise a dished or contoured unitary casting including a pair of arm rests 30 that are positioned on opposite sides of the back frame 24. Alternatively it will be appreciated by those of ordinary skill in the art that the arm rests 30 may be rigidly affixed to the back frame 24 without departing from the spirit and scope of the present invention.

A dished or contoured back cushion 32 (FIG. 4) is mounted within the back frame 24 and includes a rigid pan 34 made of plastic or other rigid or semi-rigid material to which a foam cushion 36 is adhered or otherwise secured. The foam cushion 36 includes an elongated cavity 38 formed in the back of the foam cushion 36 to provide patient comfort in the lumbar region of the patient's back. The foam cushion 36 has an increased thickness at the lumbar region to force the patient's shoulders back which naturally elevates the patient's chin and puts the patient in a good working position. The depths of the back frame 24 and the foam cushion 36 are relatively thin near the top of the back section 20 to reduce interference between the chair operator and the back section 20 in the reclined examination and treatment position of the chair 10. The arm rests 30 and dished or contoured back section 20 comfortably cradle the patient in a natural, relaxed position. In addition, the back section 20 supports an articulating headrest 40 extending above the back section 20 for comfortably supporting a patient's head. Other headrest structures, such as non-articulating with pillow, are possible as well.

Figure 4:
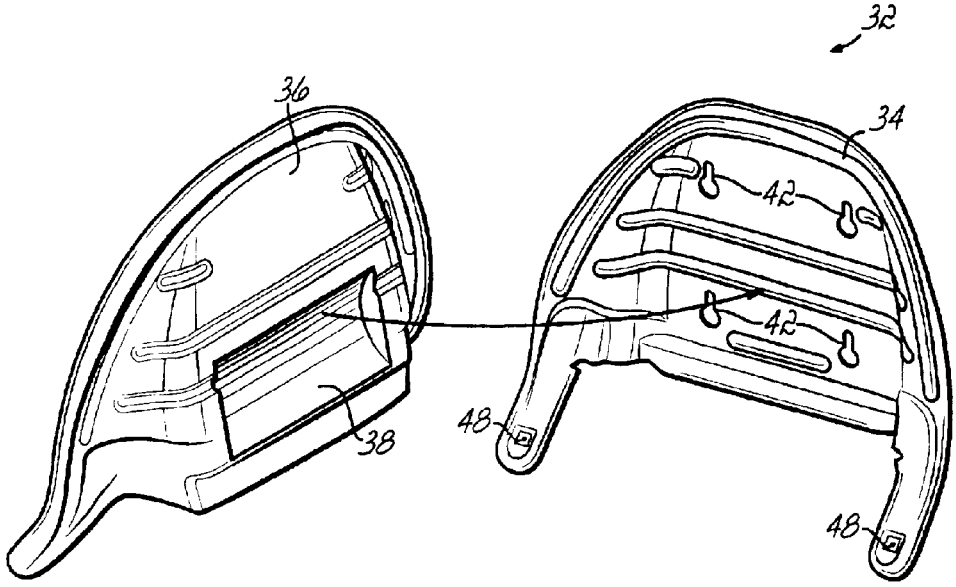
FIG. 4 is a disassembled view of a back cushion including a cushion pan and a foam cushion.

As shown in FIGS. 3 and 4, the pan 34 has multiple keyhole slots 42 that slidably receive buttons 44 projecting outwardly from the back frame 24. To install the pan 34 and foam cushion 36 to the back frame 24, the keyhole slots 42 are aligned with the buttons 44 and the pan 34 is then lowered to engage the buttons 44 with the keyhole slots 42. A pair of fasteners (not shown) extend through apertures 46 in the arm rests 30 (FIG. 3) and engage apertures 48 in the pan 34 (FIG. 4).

Figure 5:
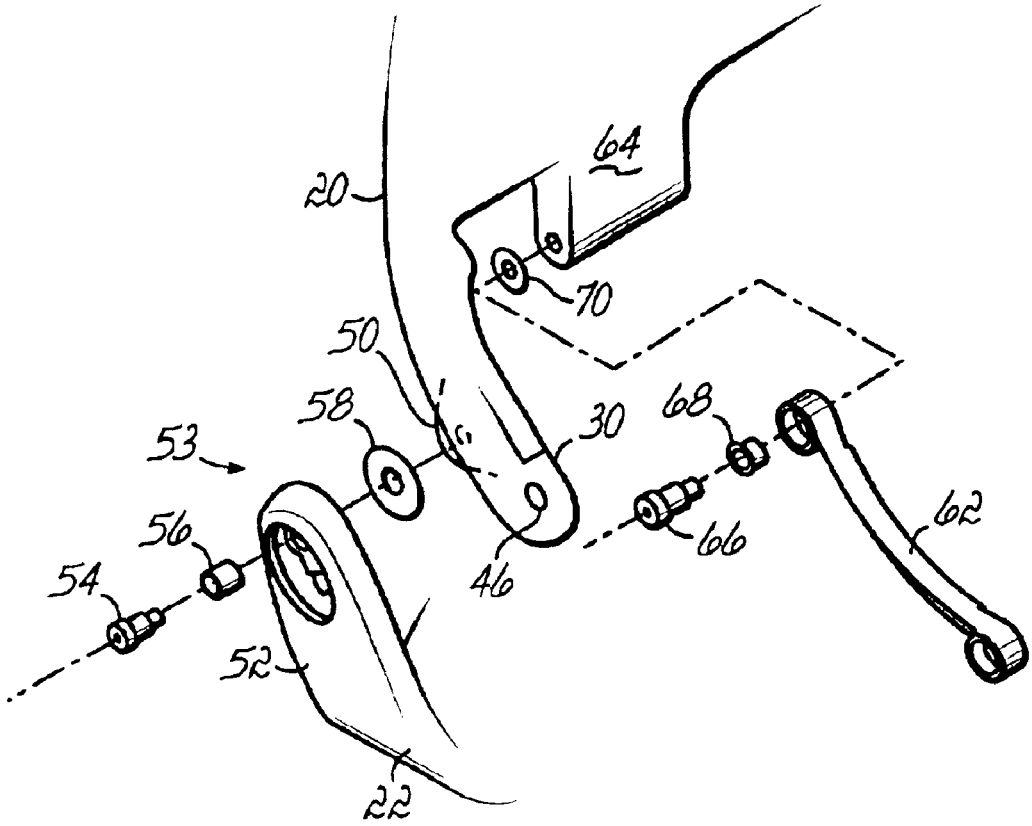
FIG. 5 is an partial disassembled view illustrating connection of the back section to a chair support and drive linkage of the chair.

As shown in FIGS. 3 and 5, a pair of pivot extensions 50 are located beneath the arm rests 30 and are pivotally connected to upstanding arms 52 of the yoke member 22 at pivotal connections 53 through shoulder screws 54, bearing sleeves 56 and washers 58 (see FIG. 5). The pivotal connections of the back frame 24 to the yoke member 22 permit the back frame to pivot between a generally upright position (FIG. 1) and a reclined position (FIGS. 2 and 3).

Further referring to FIG. 3, a drive mechanism 60, such as a hydraulic cylinder, is operatively connected to the back frame 24 through a pair of curved links 62. As shown in FIGS. 3 and 5, the curved links 62 are each pivotally connected at one respective end to a pivot extension 64 located at a lower end of the back frame 24. The curved links 62 are connected to the pivot extension 64 through shoulder screws 66, bearing sleeves 68 and washers 70 (FIG. 5). Respective opposite ends of the curved links 62 are operatively connected to a drive arm (not shown) of the drive mechanism 60 through a block 74 (FIG. 3) connected between respective ends of the curved links 62.

The seat frame 28 is pivotally connected at one end to a pair of brackets 76 through pivotal connections 78 so that the foot end of the seat frame 28 is free to pivot or lift about the pivotal connections 78. A pair of seat lift arms 80 are mounted within a slide assembly 82 and have respective ends connected to respective ends of the curved links 62. Opposite respective ends of the seat lift arms 80 operatively engage the seat frame 28 to lift the foot end of seat section 18 during movement of the chair 10 to the reclined patient examination and treatment position.

In use, as shown in FIG. 1, the chair 10 is first moved to the generally upright patient entry position through operation of a touchpad control 84 located on the side of the chair 10 or a foot control (not shown). The drive mechanism 60 extends the drive arm (not shown) which causes the back section 20 to pivot about the pivotal connections 53 (FIG. 3) to the generally upright position shown in FIG. 1. Extension of the drive arm (not shown) simultaneously causes the seat lift arms 80 to retract so that the foot end of the seat section 18 is lowered about the pivotal connections 78 (FIG. 3) to the position shown in FIG. 1. The seat section 18 has a pair of notches (not shown) formed in its opposite sides remote from the foot end that allow the arm rests 30 to pivot within the notches (not shown). In the generally upright patient entrance position as shown in FIG. 1, the arm rests 30 move with the back section 20 and are automatically positioned to allow the patient unobstructed entry into or exit from the chair 10.

After the patient has entered the chair 10, the chair 10 is moved to the reclined patient examination and treatment position through operation of a touchpad control 84 or foot control (not shown). The drive mechanism 60 retracts the drive arm (not shown) which causes the back section 20 to pivot about the pivotal connections 53 (FIG. 5) to the reclined position shown in FIG. 2. Retraction of the drive arm (not shown) simultaneously causes the seat lift arms 80 to extend so that the foot end of the seat section 18 is raised about the pivotal connections 53 (FIG. 5) to the position shown in FIGS. 2 and 3. In the reclined patient examination and treatment position as shown in FIG. 2, the arm rests 30 move with the back section 20 and are automatically positioned to comfortably support the patient's arms.

The chair 10 of the present invention provides many benefits. The chair 10 provides a patient with unobstructed entry into or exit from the chair 10 in the generally upright patient entry/exit position and a natural, relaxed and comfortable support in the reclined patient examination and treatment position. This is particularly important to accommodate elderly or handicapped patients. The foam cushion 36 provides patient comfort in the lumbar region of the patient's back and forces the patient's shoulders back which naturally elevates the patient's chin and puts the patient in a good working position. In addition, the arm rests 30 and dished or contoured back section 20 comfortably cradle the patient in a natural, relaxed position to maximize patient comfort and reduce patient anxiety.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, We claim:

1. A patient examination and treatment chair operable to move between a generally upright patient entry/exit position and a reclined patient examination and treatment position, comprising:

a chair support;

a seat section supported on said chair support;

a back section mounted for pivotal movement relative to said chair support between a generally upright position and a reclined position; and a pair of arm rests rigidly and non-pivotally connected to said back section extending along an outer periphery thereof for movement with said back section between the generally upright position wherein said arm rests are automatically positioned to allow a patient unobstructed entry into or exit from a side of the chair and the reclined position to support the patient for examination and treatment wherein said arms rests are automatically positioned to support the patient's arms.

2. The chair at claim 1 wherein said back section comprises:

a back frame; and a back cushion supported on said back frame.

3. The chair of claim 2 wherein said arm rests are integrally formed with said back frame as a unitary structure.

4. The chair of claim 3 wherein said back frame and said arms rests comprise a unitary casting.

5. The chair of claim 1 further comprising a drive mechanism operatively connected to said back section and operable to pivot sold back section relative to said chair support between the generally upright position and the reclined position.

6. The chair of claim 1 wherein said chair support comprises:

a chair base;

a lift arm supported on said chair base; and a chair support assembly supported on said lift arm and rotatably supporting said back section and said seat section.

7. The chair of claim 6 wherein said support assembly comprises:

a yoke member supported on said lift arm and pivotally supporting said back section; and a seat support operable to support said seat section.

* * * * *